United States Patent [19]

Walters

[11] 4,175,498

[45] Nov. 27, 1979

[54] SEWED SEAM RIPPER

[76] Inventor: Dean Walters, 10581 Folsom Blvd., Rancho Cordova, Calif. 95670

[21] Appl. No.: 874,128

[22] Filed: Feb. 1, 1978

[51] Int. Cl.[2] ..... D05B 37/04

[52] U.S. Cl. ..... 112/129; 83/697

[58] Field of Search ..... 112/122, 123, 124, 125, 112/126, 127, 128, 129, 130, 235; 83/697

[56] References Cited

U.S. PATENT DOCUMENTS

| | | | |
|---|---|---|---|
| 216,322 | 6/1879 | Glanville | 112/128 |
| 1,433,705 | 10/1922 | De Voe | 112/125 X |
| 2,452,312 | 10/1948 | McMurray | 83/697 X |
| 2,493,735 | 1/1950 | Alifano et al. | 112/128 |
| 2,580,146 | 12/1951 | Williams | 83/697 |

FOREIGN PATENT DOCUMENTS

| | | | |
|---|---|---|---|
| 561378 | 10/1957 | Belgium | 112/129 |

*Primary Examiner*—Louis Rimrodt

*Attorney, Agent, or Firm*—Mark C. Jacobs

[57] ABSTRACT

An apparatus for cutting sewed seams for use in combination with a home-type sewing machine is disclosed. The unit is lightweight, low cost and may be manufactured to fit any brand of sewing machine.

8 Claims, 9 Drawing Figures

SEWED SEAM RIPPER

BACKGROUND OF THE INVENTION

1. Field of the Invention

This invention concerns a sewed seam ripper for use in combination with a regular sewing machine such as utilized in school, homes, and in dressmaking establishments.

2. Description of the Prior Art

Oftimes it becomes necessary to rip seams of garments when one's size changes, or when one desires to alter the garment to make it larger or smaller. Many women especially, cut threads of a seam with a scissors or a safety razor or a sharp knife. Such tools are slow and tedious. There is indeed also the risk of cutting undesired areas.

One seam ripper known to applicant is that of Lawrence U.S. Pat. No. 2,520,769. However, this device requires the user to remove the sewing needle in that the ripper is inserted in the needle holder. This is time consuming and for persons whose eyes are not up to par, may be difficult to carry out, especially as to the back and forth replacement of the ripper and the needle.

A very sophisticated device is that of Kropf U.S. Pat. No. 3,848,554. This cutting device for sewing machines will cut tape, lace or the like. Such a device, however, is not intended primarily for home use.

Still another cutting device intended primarily for tape cutting is that shown in U.S. Pat. No. 2,681,019 where the cutting blade stikes a stationary anvil.

A device intended specifically for a Superlock sewing machine manufactured by Willcox and Gibbs Company, is disclosed in U.S. Pat. No. 3,257,979. However, such a device is only intended to be limited to the Willcox and Gibbs Machine.

Another patent that discloses blades that move up and down by air pressure and which is intended for commercial utilization is shown in Burton U.S. Pat. No. 3,369,509.

SUMMARY OF THE INVENTION

According to the invention, there is disclosed a novel seam ripping device that is highly efficient, simple in construction, durable, lightweight and easy to use. The present invention relates to a cutting mechanism for cutting sewed seams primarily and which may also be utilized for cutting tape and other materials. With the instant device inserted on a machine instead if the normal pressure foot, the seam can be passed along under the cutting edge of the ripper as it moves upwardly and downwardly by operation of the sewing machine, thereby cutting the threads. It is also to be seen that material can also be cut in like manner.

It is an object of the instant invention to provide an apparatus for cutting sewed seams to render altering of garments easier. It is a further object to devise a cutting mechanism which may be embodied in the form of an attachment capable of being mounted on a sewing machine. It is another object to devise a seam ripper which can be manufactured to fit on every home sewing machine or which may be manufactured in one format with suitable adaptors for use with almost every home owned sewing machine.

It is another object to provide a low cost seam ripper which can be attached to every home sewing machine with no modification of the machine.

Still another object is to provide a cutting arrangement which will avoid interference with the standard cloth feeding dog. Still another object is to devise a seam ripping device which will not require the removal of a needle from its mounting in the sewing machine.

The nature of the invention and other objects and advantages will in part be obvious from the following description of the preferred embodiment and as amplified in the appended claims.

DESCRIPTION OF THE PREFERRED EMBODIMENT

Figure 1:
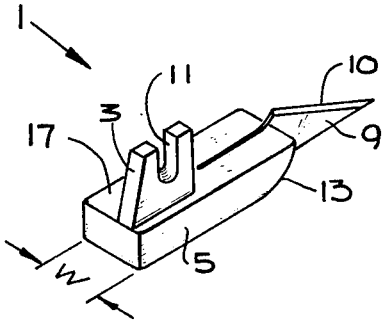
FIG. 1 is a perspective view of one embodiment of this invention wherein the knife is wedge fit into the blade retaining foot.

Turning now to the drawing, it is seen in FIG. 1 there is disclosed a seam ripper 1 comprising a generally rectangular solid foot having a downwardly and rearwardly bevelled front face 13 and a slit extending the elevation rearwardly from said front face. Preferably the slit is about two thirds the distance of the length of the foot. Blade 9 is friction bound in said slit and said blade has a cutting edge 10 projecting downwardly and forwardly toward the material. On the upper surface of said foot, at the rear portion thereof and secured thereto, is shank 3. Preferably shank 3 is secured to foot 5 in the left rear portion of said foot as seen from the front of the instant invention as per FIG. 2. Shank 3 may be secured to foot 5 by adhesion or through suitable securing means such as screws. Shank 3 is disposed upwardly from the foot preferably at the location indicated. However, it may be centered with respect to the width indicated as w, of foot 5. Shank 3 is seen to have a forwardly inclined top surface and a vertically extending notch 11 therein. Notch 11 extends downwardly the full width of the shank. The depth of the notch will vary with the shank which is sized for a particular brand of sewing machine. Sizing to suit the machine is carried out by varying the elevation of shank 3 and by altering the configuration of the notch therein such that it will mate with the pressure foot shaft of the machine for engagement and operation. In certain embodiments, the incline of the top wall of said shank may approach the horizontal, such as in the embodiment of FIG. 3. In all embodiments, however, the notch will extend downward and slightly forward as shown in the FIG. 3 embodiment. It should be understood that what is desired is to have the shank connect easily to the pressure foot of the particular machine it is being fitted to. Thus a slant needle Singer may require a particular angular shank to mate with the foot shaft of that machine. In addition, straight stitch machines made by such manufacturers as White, New Home and others, of a vintage prior to 1950, such machines commonly being called "old style," may require a particular angle on the shank portion of my device to mate with the pressure foot shaft of such machines. It is obvious that it is within the skill of the art to measure the angle of the pressure foot shaft of any machine and then produce a shank for my device of a corresponding angle that will mate therewith.

In any event, about 90% of the machine made today will accept one of two standard high and standard low shank models, due to conformity in design by sewing machine manufacturers.

Figure 2:
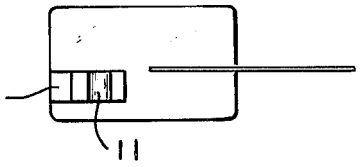
FIG. 2 is a top plan view of the embodiment of the invention of FIG. 1.

FIG. 2, a top plan view of an alternate embodiment to that of FIG. 1, shows but one modification to said FIG. 1 embodiment. In this embodiment, the four corners are seen to be slightly rounded off for ease of manufacturing and handling. By avoiding sharp corners, there is less chance that the fabric will become entangled, snarled or cut by any sharp corners on the pressure foot.

Figure 3:
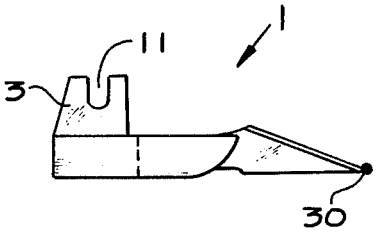
FIG. 3 is a vertical elevation of the embodiment of the invention as shown on FIG. 1.

In FIG. 3 there is shown a vertical elevational view of the embodiment of FIG. 1.

Figure 4:
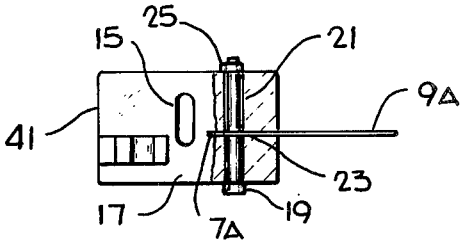
FIG. 4 is an alternate embodiment wherein the knife blade instead of being wedge fit is inserted into a groove or slot in the foot and is retained in place by a keyed screw or locking device. Also shown in this embodiment is an aperture in which the needle moves upwardly and downwardly during the course of travel of the instant device such that the needle need not be moved from its moorings during the operation of the instant device.

In FIG. 4 there is shown yet another embodiment of the instant invention. In this embodiment the blade 9*a* is shown inserted into the slit *7a* of seam ripper 41. Bore 21 extends through the foot 5 and is disposed in a straight line the width of said foot. Bore 21 is positioned at approximately the mid-point of the elevation of said foot. However, the location of said bore is not critical and it may be at any point along the length of the foot so long as it can communicate with aperture 23 within knife blade A in order for form a continuous straight passage for bolt 19. Bolt 19 is inserted through the bore 21 of foot 5, through knife blade 9*a*'s aperture 23, through the balance of the bore 21 of the foot and connected to nut 25. Nut 25, when secured to bolt 19, is seen to abut the elevational side of foot 5.

The instant invention is seen not to act as a replacement in the needle mounting. Rather it goes on the pressure foot shaft. When the embodiment of FIG. 1 is employed, it is necessary to remove the needle in order to mount the instant device. The alternative is to employ an embodiment such as that of FIG. 4 wherein a vertical hole 15 is inserted in the foot 5 to communicate with the upper and lower surfaces of the foot. The hole is of a cross section greater than that of the needle such that when the needle is left mounted in its normal operating position, it will be able to move upwardly and downwardly through said hole. Since the needle will be unthreaded, it will achieve no sewing action. By having the hole sized appropriately, suitable clearance will be present at all times during the operation of the instant device. Since the feed dogs cause the instant device to go up and down as the material is pushed through, the pressure foot does raise and lower with the whole shaft such that the needle's angle of entry into hole 15 will be constantly but repetitively changing.

Figure 6:
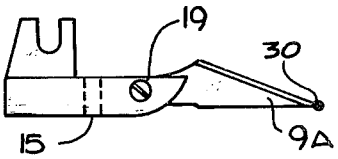
FIG. 6 is a vertical elevational view of the embodiment of FIG. 4.

FIG. 6 is a vertical elevational view of the embodiment of FIG. 4 and shows in dotted lines the hole for the entry and egress of the needle when the instant device is employed. It is to be noted however, that the total vertical distance of travel is only about ⅛ inch up and down, for the device.

Figure 5:
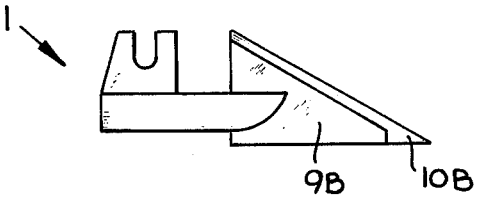
FIG. 5 is yet another embodiment of the instant invention wherein an alternate blade is employed, intended primarily for cutting cloth or thread.

In FIG. 5 there is shown an elevational view of another embodiment of the instant invention. In this embodiment the shank is from the rear edge of the foot. Shown here is an alternate blade 9B intended primarily for the cutting of cloth or tape and having a cutting surface 10B. It is seen therefore that it is not necessary for the shank to abut the rear wall of the foot.

Previously I have indicated that the foot and shank can can be made as separate pieces. These can be adhesed together by use of readily available cements. Thus for acrylic, one can employ ethylene dichloride.

The shapes depicted in the figures are all rectangular for the foot. However, a solid quadrilateral of either a square or rectangle can be employed.

Figure 7:
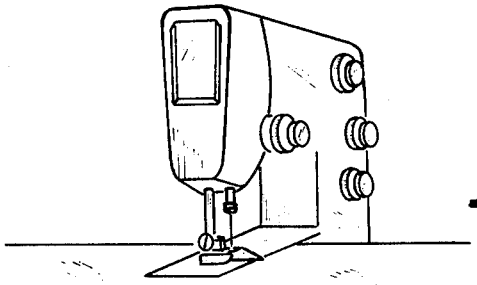
FIG. 7 is a perspective view of one embodiment of this device shown mounted in operative position on a sewing machine.

FIG. 7 depicts a typical state of the art sewing machine with the invention of this application mounted thereon.

Figure 8:
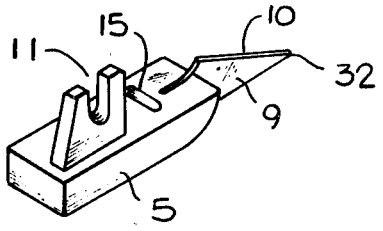
FIG. 8 is a top plan view of another embodiment of this invention.

FIG. 8 is another embodiment of this invention. It is a "hybrid" based on the version of FIG. 4, in that the aperture 15 is present, but no blade retaining means of a bolt and nut is employed, the blade being frictionally engaged only.

Figure 9:
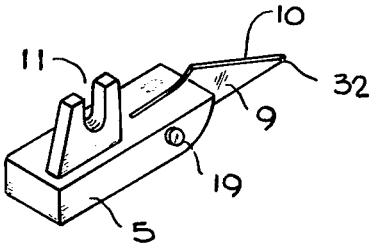
FIG. 9 is a top plan view of still another embodiment of this invention.

FIG. 9 is still another embodiment of this invention, wherein a blade retaining means is employed, but no aperture 15 is present.

It is also seen, that other blade retaining mechanisms can be employed, rather than the bolt passing through an aperture in the blade, said bolt being secured by a nut. For example a set screw could impinge upon the blade to help hold it in place.

In so far as the device is concerned, the shaft and foot may be cast as an integral unit, or they may be formed separately and secured one to the other. I have found that acrylic or methacrylic plastic may be suitably used among the plastic materials, especially since it is available colorless, such that one can see all of the fabric at all times. Other suitable materials include aluminum and magnesium.

It is seen from the figures that the device has a forwardly tapering leading edge, from bottom to top. By employing such a shape, one obtains a clean non-impeded feed of the cloth. A flat front surface will cause the cloth to bunch up at the point of impact with the device.

With respect to the blade portion, it is preferred to have the bottom edge of the blade co-extensive with the bottom edge of foot, again to prevent impaired feeding.

In the embodiments discussed above, the knife blade was removeable and re-insertable at will. Either the same or another blade could be inserted. It is also within the scope of this invention to provide a low cost throw-away unit which would have the blade permanently anchored into place. Such a unit is readily manufactured by casting the plastic in the mould around the blade.

While any suitably sized blade is operable, it is preferred to have a slightly rounded point both to avoid accidental cutting of the fabric by the point, and to prevent injury to hands operating in the work place area. Such a blade is shown in FIGS. 8, and 9. In order to prevent the injury aforesaid in all of other embodiments, the point has been coated with a polymeric substance such as Teflon ®, such coated dot being designated 30 in FIGS. 3 and 6. The employment of the rounded edge 32 or the polymer tip in no way interferes with the cutting action of the blade, since the cutting takes place further up the cutting surface.

The instant device is perceived to be applicable to almost all types of sewing machines, of all manufacturers, domestic, Asian and European. Machines contemplated for use with the instant invention include those by Singer, Brother, Necchi and others.

It may however by necessary in some instances to employ a shaft of differing heights. It is believed that the width and depth of the shaft may be maintained uniformly, as this will reduce manufacturing costs. The height of the shaft is seen to be within the range of from about ¼ inches to about 2 inches overall. It may also be necessary, in certain circumstances to enlarge or reduce the size of the opening, 11, for the thumb screw, not seen, which is used to secure the device in place. Reference is made to FIG. 7 which shows one of the instant devices installed on a sewing machine.

Large commercial machines will require a shaft height of about 1" to 2" whereas homestyle smaller machines will run from ¼" to about 1" for shaft height.

In the embodiments shown in FIGS. 1,3,5, and 6 the rear wall of the shank tapers inward. This is preferred, but not required. By reducing the thickness at the top, where the foot engages the machine, the chances of interfering parts inhibiting mounting of the device are minimalized.

In the embodiment of FIGS. 8 and 9 the shank is seen to be moved forwardly from abutment with the rear wall of the foot. One of these has a forwardly sloping rear surface on the shank, while the other does not.

OPERATION OF THE INVENTION

Turning now to FIG. 7, it is seen that needle 26 is shown mounted in 27, the needle holder, which in turn is secured to the needle bar 28. Cloth 29 is urged forwardly toward blade 9 while blade 9, being secured within foot 5, moves upwardly and downwardly over a path that does not exceed about 3/16 inches in any machine.

In those embodiments that do not have an aperture 15, it is mandatory to first remove the needle prior to operation of the instant device, or to lock it upward in place such that it can not reciprocate during use of the instant device. Failure to do so could damage the needle. Thus the benefit to be derived from using the embodiment such as FIG. 4 wherein a slot is provided. On the other hand, it is seen however, that if the needle 26 is permitted to reciprocate, clumsy feeding of material to be cut by the operator could result in perforations in the cloth.

While I have shown and described the preferred embodiment of my invention, I do not wish to limit same to the exact and precise details of the recited structure, but rather I reserve the right to make all modifications and changes that fall within the scope and spirit of this invention and the appended claims.

I claim:

1. A seam ripper adapted for mounting on a sewing machine in place of the pressure foot comprising a solid quadrilateral foot having a downwardly and rearwardly slanted front face and a rearwardly extending elevational slit adapted to receive a frictionally engageable cutting blade, a shank secured to said foot and disposed upwardly therefrom and said shank having a downwardly extending notch therein, blade retaining means on said foot and a vertically disposed cutting blade frictionally engaged in said slit and retained in said foot by said blade retaining means, the bottom edge of the blade being substantially co-extensive with the bottom edge of the foot.

2. The seam ripper of claim 1 wherein the shank is secured to the foot by adhesion, and said foot is a solid quadrilateral.

3. The seam ripper of claim 1 wherein said foot has a vertical hole therein adapted to and suitably positioned such that a vertically moving sewing needle of the sewing machine can reciprocate unimpeded throught said hole.

4. The seam ripper of claim 3 further including a blade retaining means on said foot, and a cutting blade retained by said blade retaining means and engaged by said slot.

5. The seam ripper of claim 1 wherein the foot is generally rectangular and said foot and said shank are one piece.

6. The seam ripper of claim 1 wherein a bore extends from one side of said foot to the opposite side of said foot, said bore being horizontal to said slit and passing throught the area defined by said slit, blade retaining means comprising a bolt passing through said bore and a nut secured at the end of said bolt, said blade having an aperture therein that aligns with said bore when said blade is frictionally engaged in said slit.

7. In the seam ripper of claim 1 wherein the foot is made of molded plastic and the blade retaining means is cast plastic around the blade to retain the blade within the foot.

8. The seam ripper of claim 7 wherein said foot has a vertical hole therein adapted to and suitably positioned such that a vertically moving sewing needle of the sewing machine can reciprocate unimpeded through said hole.

* * * * *